US009752572B2

(12) United States Patent
Parsons et al.

(10) Patent No.: US 9,752,572 B2
(45) Date of Patent: Sep. 5, 2017

(54) VARIABLE FLOW HYDRAULIC MACHINE

(71) Applicant: Concentric Birmingham Limited, Erdington (GB)

(72) Inventors: Bryan Parsons, Erdington (GB); Paul Shepherd, Erdington (GB); Steven Hodge, Erdington (GB)

(73) Assignee: CONCENTRIC BIRMINGHAM LIMITED, Birmingham (GB)

( * ) Notice: Subject to any disclaimer, the term of this patent is extended or adjusted under 35 U.S.C. 154(b) by 344 days.

(21) Appl. No.: 14/478,111

(22) Filed: Sep. 5, 2014

(65) Prior Publication Data

US 2015/0071804 A1 Mar. 12, 2015

(30) Foreign Application Priority Data

Sep. 6, 2013 (GB) ..... 1315916.5

(51) Int. Cl.

| | |
|---|---|
| ***F04C 2/18*** | (2006.01) |
| ***F04C 14/22*** | (2006.01) |
| ***F01C 21/10*** | (2006.01) |
| ***F01C 1/18*** | (2006.01) |
| ***F04C 18/18*** | (2006.01) |
| ***F01C 20/22*** | (2006.01) |
| ***F04C 28/22*** | (2006.01) |
| ***F04C 2/08*** | (2006.01) |

(52) U.S. Cl.

CPC ..... *F04C 2/18* (2013.01); *F01C 1/18* (2013.01); *F01C 20/22* (2013.01); *F01C 21/106* (2013.01); *F04C 2/086* (2013.01); *F04C 14/22* (2013.01); *F04C 18/18* (2013.01); *F04C 28/22* (2013.01)

(58) Field of Classification Search

CPC ..... F04C 14/18; F04C 14/22; F04C 14/223; F04C 14/226; F04C 28/18; F04C 28/22; F04C 2/18; F04C 2/126; F04C 18/18; F04C 18/126; F04C 15/0026; F01C 20/18; F01C 20/22; F01C 21/106; F01C 2021/1606; F01C 2021/1612; F01C 1/18; F01C 1/126

USPC ..... 418/206.1, 206.6, 206.7, 22, 131, 132

See application file for complete search history.

(56) References Cited

U.S. PATENT DOCUMENTS 1,602,740 A * 10/1926 Bechler ..... F04C 14/22 418/19
1,704,704 A * 3/1929 Grant ..... F04C 14/22 418/19

(Continued)

FOREIGN PATENT DOCUMENTS

DE 10 2007 051349 A1 4/2009

OTHER PUBLICATIONS

United Kingdom Search Report for GB 1315916.5 dated Feb. 28, 2014.

*Primary Examiner* — Mark Laurenzi
*Assistant Examiner* — Xiaoting Hu
(74) *Attorney, Agent, or Firm* — Buchanan, Ingersoll & Rooney PC

(57) ABSTRACT

A variable flow external rotor hydraulic machine (10, 10') has an inlet (26, 26') an outlet (28, 28'), a rotor set having a first rotor (58, 58') mounted for rotation about a first rotor axis and a second rotor (68, 68') mounted for rotation about a second rotor axis, the machine being configured as either a pump or a motor, in which at least one of the first and second rotor axes is movable relative to the other to vary a leakage flow between the rotors.

13 Claims, 8 Drawing Sheets

(56) References Cited

U.S. PATENT DOCUMENTS

| | | | | | |
|---|---|---|---|---|---|
| 2,606,503 | A * | 8/1952 | Shaw | F04C 14/223 | 417/213 |
| 2,754,765 | A * | 7/1956 | Joy | F04C 14/22 | 418/19 |
| 2,895,422 | A * | 7/1959 | Gold | F04C 2/18 | 418/19 |
| 2,948,228 | A * | 8/1960 | Ahlen | F04C 2/10 | 418/107 |
| 3,107,629 | A * | 10/1963 | Wiggermann | F04C 2/084 | 418/19 |
| 3,782,114 | A * | 1/1974 | Broes | B63H 11/08 | 415/61 |
| 4,531,898 | A * | 7/1985 | Ideta | F04C 14/226 | 417/220 |
| 8,684,702 | B2 * | 4/2014 | Watanabe et al. | F04C 14/226 | 417/220 |
| 2009/0074598 | A1 * | 3/2009 | Tanasuca | F01C 21/0827 | 418/27 |
| 2012/0301342 | A1 * | 11/2012 | Ohnishi et al. | F04C 14/223 | 418/25 |
| 2013/0209302 | A1 * | 8/2013 | Ono et al. | F04C 2/102 | 418/17 |

* cited by examiner

VARIABLE FLOW HYDRAULIC MACHINE

The present invention is concerned with a variable flow hydraulic machine. More specifically, the present invention is concerned with a variable flow external rotor pump such as a gear pump or lobe pump for liquids such as water and oil.

By "hydraulic machine" we mean an apparatus for the conversion between fluid and mechanical energy. This may be in either direction—i.e. from mechanical to fluid for a pump, or from fluid to mechanical for a motor.

Variable flow pumps are known in the art. Such pumps can vary their output independently of the speed at which they are driven. As such, variable flow pumps can be directly driven by e.g. a vehicle engine (which runs at speeds unrelated to pump demand), whilst maintaining an output based on the required pressure—e.g. from the oil gallery in a vehicle. As such wide variations in the running speed of the pump do not result in similar variations in system oil pressure.

There are many types of positive displacement pumps known in the art. One example is a gear pump, in which cavities between the teeth of a gear are used to displace fluid from an inlet to an outlet. An external gear pump comprises two meshed, contra-rotating gears which are contained within a pump cavity within a housing. At the external sides of the gears, semicircular surfaces are positioned which seal against the tips of the gear teeth as they move. An inlet is positioned on one side of the gear set, and an outlet on the opposite side. The gears rotate such that the teeth move from the inlet to the outlet around the external sides of the pump cavity, such that finite volumes of fluid are transported from the inlet to the outlet in the cavities formed between the teeth and the housing surfaces. Because the gear teeth are meshed, when they return from the outlet to the inlet very little high pressure outlet fluid is displaced back to the inlet.

An alternative type of pump, an internal gear pump or gerotor pump, uses a first gear mounted for rotation within a second gear, the first gear having axis of rotation offset from the second gear and having fewer teeth. One side of the first gear is meshed with the second gear.

Variable flow internal gear pumps are known in the art. A variable flow internal gear pump is disclosed in published application GB2445243, in which two adjacent rotors of an internal gear pump are provided, one of which has a movable axis to vary the flow rate of the pump.

Another type of positive displacement pump is a lobe pump. Lobe pumps are similar to gear pumps with the exception that the lobes (teeth) do not mesh. Synchronisation of the rotors is carried out by external means (e.g. a gearbox). For the purposes of this application, external gear pumps and lobe pumps will be referred to as "external rotor pumps"

It is known that variable flow internal gear pumps can be inefficient when unloaded (i.e. at low flow). External gear pumps do not suffer from the same problem. What is required is an external gear pump where the flow can be varied independent of speed, thus combining the advantages of variable flow with those of the external gear pump architecture.

The above mentioned problems are also relevant to hydraulic motors (i.e. where a working fluid is used to drive a mechanical output shaft). Therefore the invention aims to provide an improved variable flow hydraulic machine in general.

According to the invention there is provided a variable flow external rotor hydraulic machine comprising:

an inlet;

an outlet;

a rotor set having a first rotor mounted for rotation about a first rotor axis and a second rotor mounted for rotation about a second rotor axis, the rotor set being configured to either:

(i) when driven, pump fluid from the inlet to the outlet; or, (ii) be driven by a working fluid passing from the inlet to the outlet;

in which at least one of the first and second rotor axes is movable relative to the other to vary a leakage flow between the rotors.

Advantageously, by moving the relative position of the rotors, the leakage flow between them can be varied, and as a result the net flow and therefore outlet pressure can be varied. As mentioned, the machine may be configured as either a pump or a motor.

Preferably the first rotor axis is stationary, and the second rotor axis is movable. This makes it easier for the first rotor to be driven by an external power source, or to deliver mechanical power to a single shaft. The second rotor may be driven by the first rotor (i.e. is it an idler).

Preferably the variable flow external rotor hydraulic machine, comprises:

a housing; and, a carrier movable relative to the housing;

in which the movable rotor is mounted on the carrier.

This allows the carrier to provide a surface facing the movable rotor, in which the movable rotor and surface cooperate to pump fluid from the inlet to the outlet (or to be rotated by the working fluid if the machine is a motor).

Preferably the carrier is rotatably mounted in the housing. This results in a simple and robust construction which is less likely to jam than a sliding carrier.

In one embodiment, there is provided a linear actuator arranged to move the carrier. The carrier may have a carrier axis, in which the linear actuator is arranged to apply a force to the carrier spaced apart from the carrier axis (e.g. the opposite end of the carrier). The carrier may be resiliently biased—preferably to a maximum flow condition for failsafe reasons.

Preferably the linear actuator is a hydraulic actuator.

The hydraulic actuator may be controlled by a control valve driven by a pressure downstream of the pump outlet. The control valve may be actuated by a pressure downstream of the outlet to form a closed loop control. The control valve may be configured to power the hydraulic actuator using a flow downstream of the outlet.

In an alternative embodiment, the carrier may form a carrier pressure chamber with the housing on the opposite side of the carrier to the movable rotor, in which the position of the carrier is responsive to pressure in the carrier pressure chamber. As such the carrier may comprise a sealing region for sealing against a corresponding surface of the housing. At least one of the sealing region of the carrier and the corresponding region of the housing may comprise a circle segment surface with a geometric centre at the carrier axis of rotation.

Preferably at least one of the sealing region of the carrier and the corresponding region of the housing comprises a seal.

Preferably the sealing region of the carrier is spaced apart from the carrier axis to make the chamber as large as possible (and thereby increase the pressure force on the carrier).

Preferably the pressure chamber comprises a flow passage for controlling the pressure therein. The pressure in the pressure chamber may be controlled by a control valve driven by a pressure downstream of the pump outlet. The control valve may be actuated by a pressure downstream of the outlet, thus forming a closed loop system.

Preferably the control valve is configured to supply the pressure chamber using a flow downstream of the outlet.

According to a second aspect of the invention there is provided a method of controlling the flow in an external rotor hydraulic machine comprising the steps of:

providing an external rotor hydraulic machine having a rotor set positioned between an inlet and an outlet, the rotor set having a first rotor mounted for rotation about a first rotor axis and a second rotor mounted for rotation about a second rotor axis;

either:

(i) rotating the first and second rotors about their respective axes to pump fluid from the inlet to the outlet; or, (ii) providing a high pressure fluid at the inlet to rotate the first and second rotors about their respective axes as the fluid passes to the outlet to generate a mechanical output; and, varying the output of the hydraulic machine by moving one or both of the first and second rotor axes relative to the other.

It will be understood that any of the above described aspects of the invention, or preferable/optional features may be used for a hydraulic pump or a hydraulic motor.

An example variable flow pump in accordance with the present invention will now be described with reference to the accompanying figures in which:

FIG. 1*a* is a part-sectioned side view of a first pump in accordance with the present invention in a first operating condition;

FIG. 1*b* is a side part-sectioned view of the pump of FIG. 1*a* in a second operating condition;

FIG. 2*a* is a schematic view of the pump of FIG. 1*a* with a first control scheme;

FIG. 2*b* is a hydraulic circuit diagram of the pump of FIG. 1*a* controlled according to FIG. 2*a;*

Figure 4:
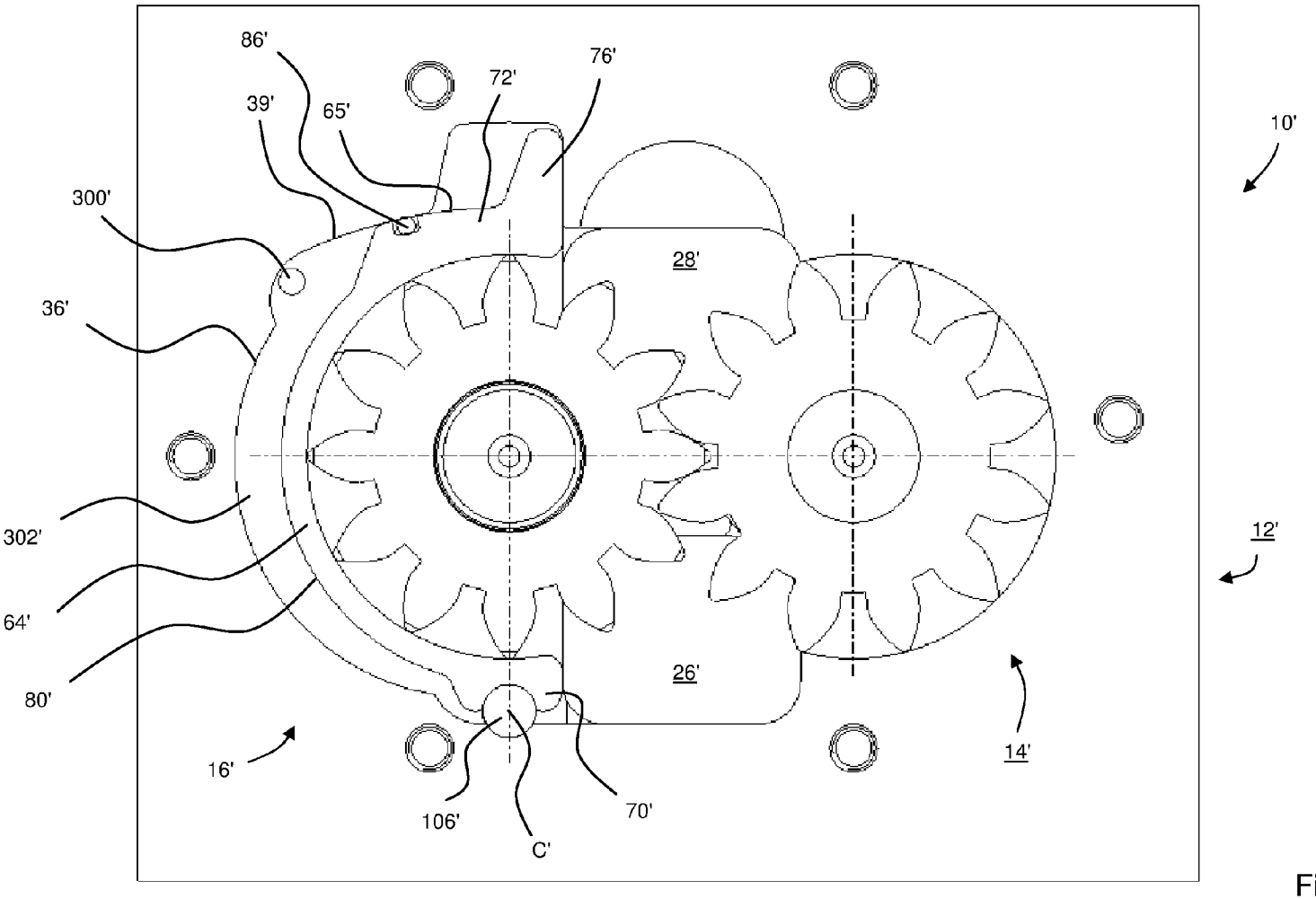
FIG. 4 is a side view of a second pump in accordance with the present invention.
Figure 5A:
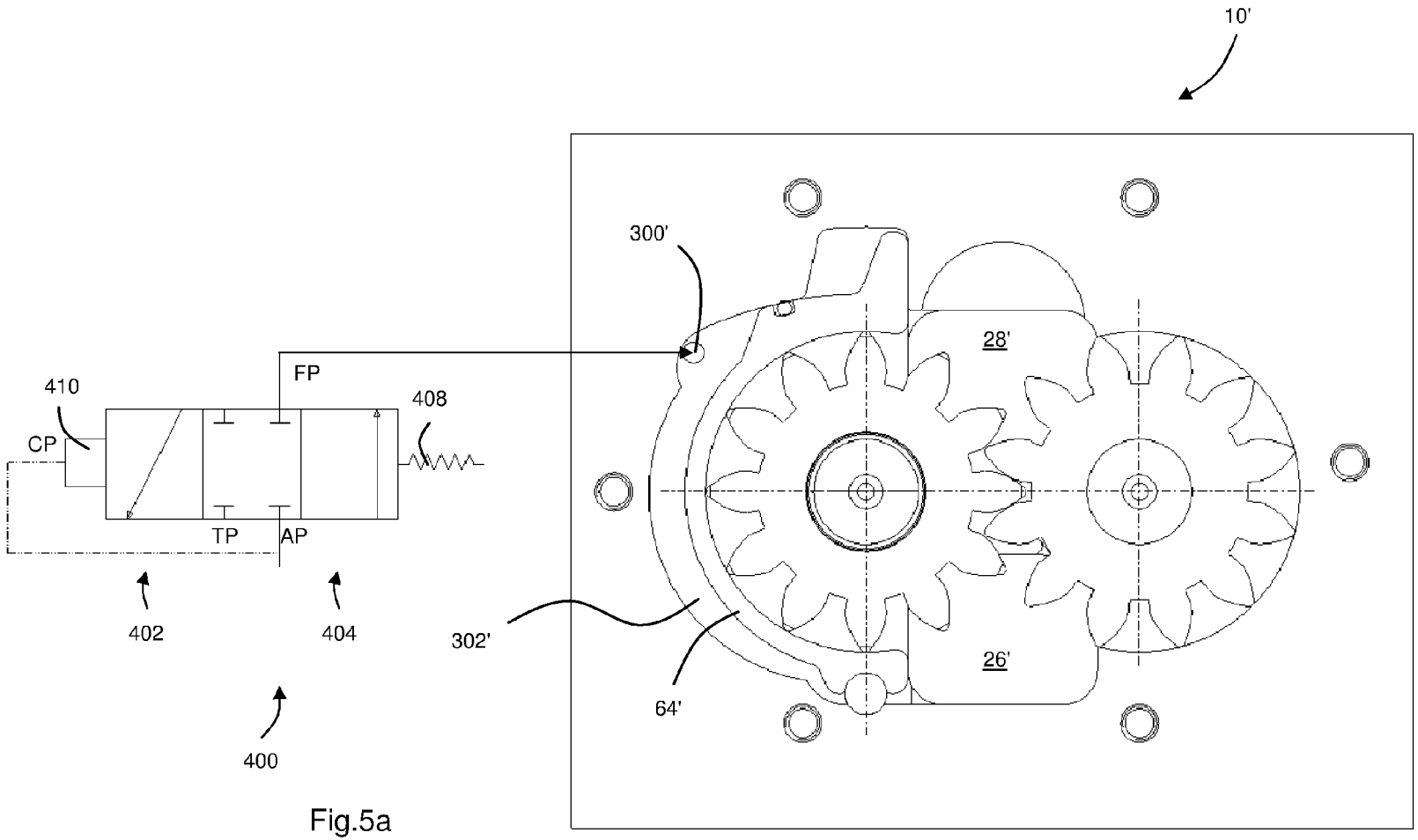
Figure 5B:
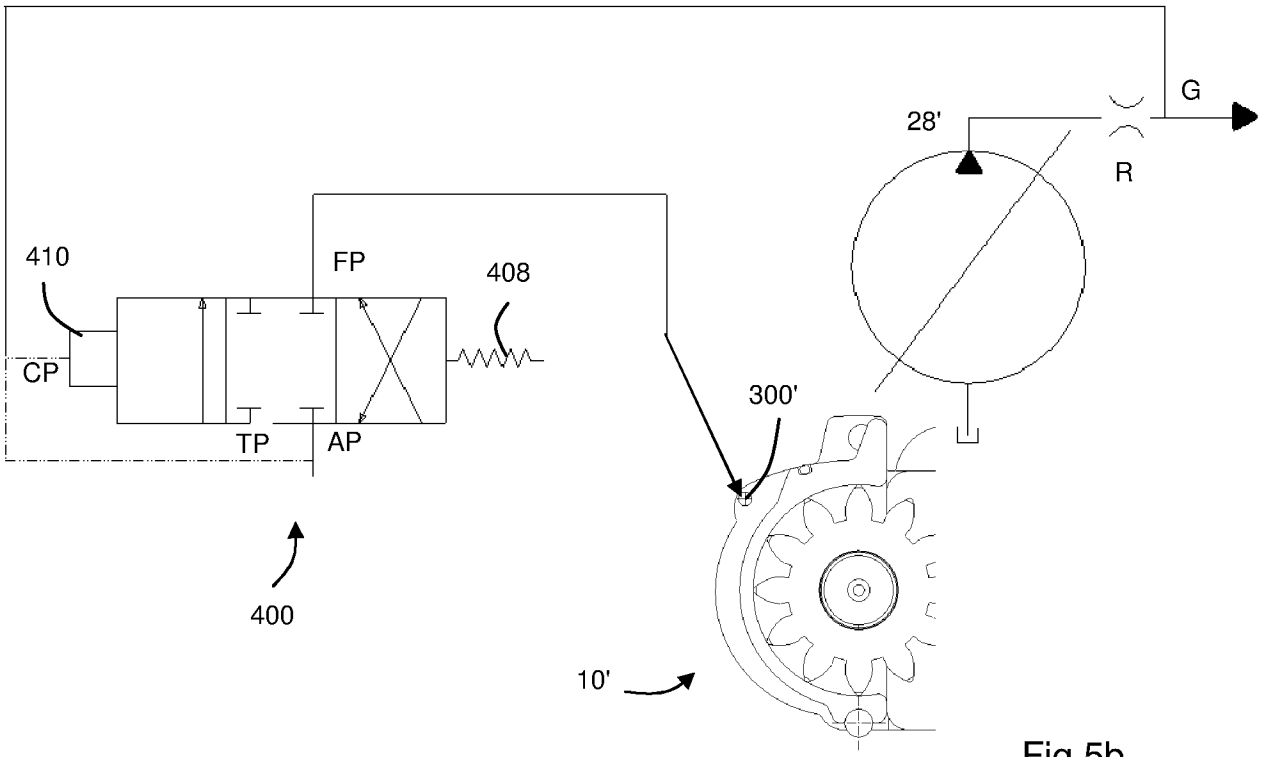
Figure 6:
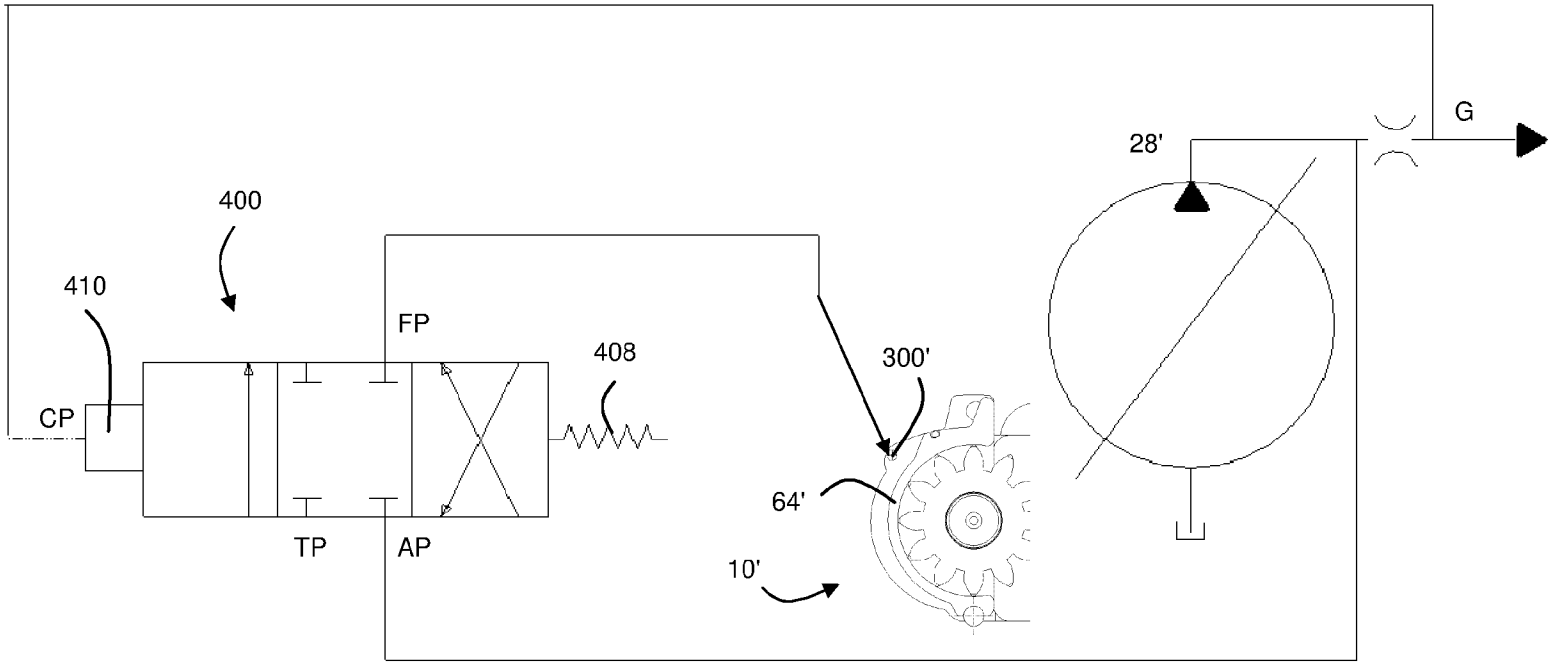

FIG. 5*a* is a schematic view of the pump of FIG. 4 with a first control scheme;

FIG. 5*b* is a hydraulic circuit diagram of the pump of FIG. 4 controlled according to FIG. 5*a*; and, FIG. 6 is a schematic view of the pump of FIG. 4 with a second control scheme.

Figure 1B:
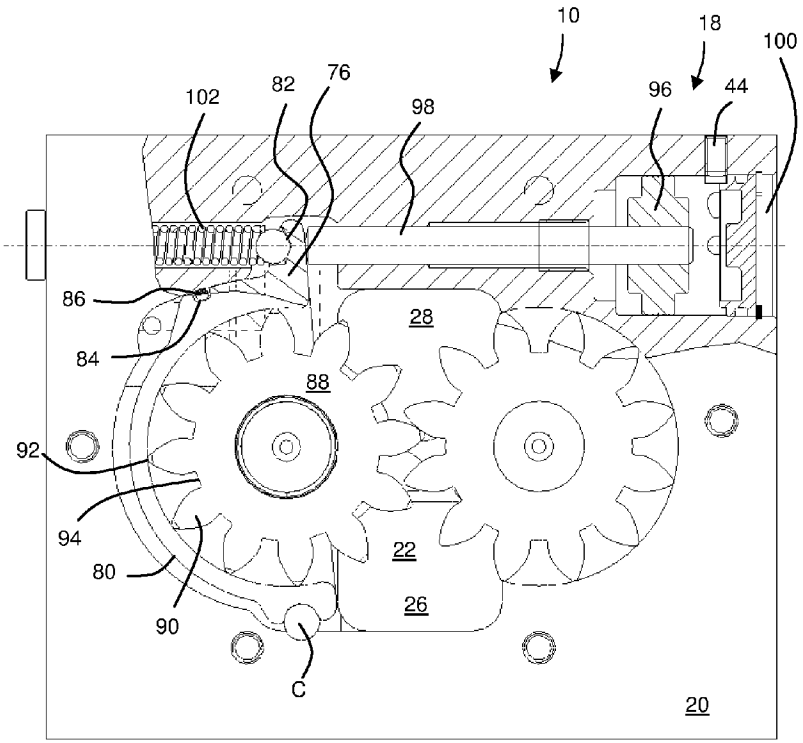
Figure 1A:
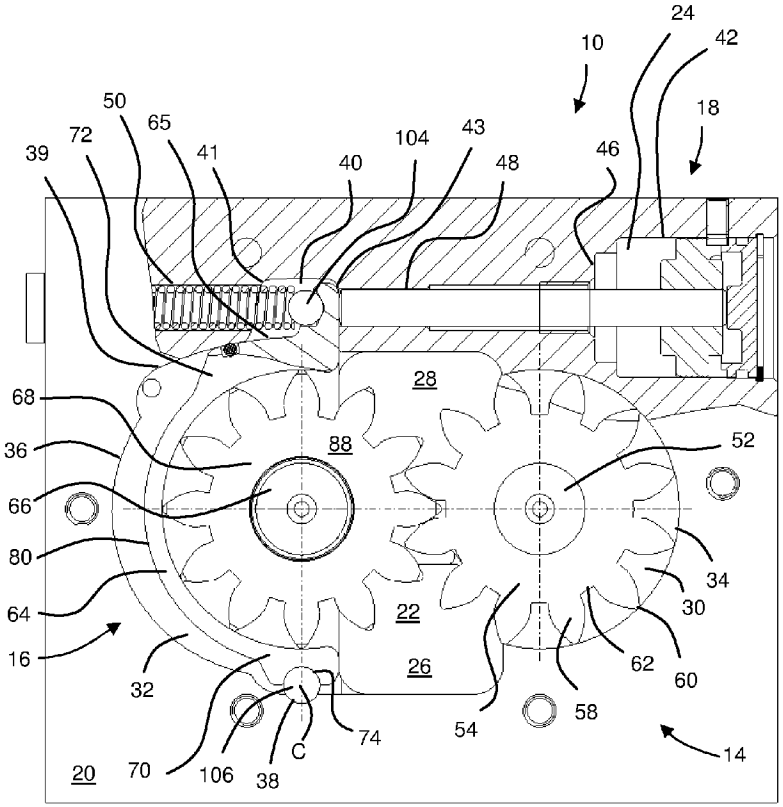

Turning to FIGS. 1*a* and 1*b*, there is shown a variable flow external gear pump 10 comprising a housing 12, a driving gear assembly 14, a driven gear assembly 16 and a variable flow control actuator 18.

The housing 12 comprises a body 20 having a pump cavity 22 and an actuator cavity 24 defined therein. The pump cavity 22 defines an inlet 26 which is in communication with an external source of fluid (not shown), an outlet 28 which is in fluid communication with an area for pressurised fluid to be delivered, and a pair of opposed gear cavities 30, 32 positioned side-by-side between the inlet 26 and the outlet 28. The first gear cavity 30 is partially bounded by a semi-circular section gear pump contact surface 34. The second gear cavity 32 is partially bounded by a carrier facing surface 36, which is also generally semi-circular but of larger radius than the gear pump contact surface 34.

At a first end of the carrier facing surface 36 proximate the inlet 26 there is provided a carrier rotation pin receiving formation 38. Proximate the outlet 28 of the carrier facing surface 36 there is provided a concave sealing region 39 describing a circle segment and having a geometric centre coincident with the centre of the carrier pin receiving formation 38. The sealing region 39 terminates in a radially outwardly extending carrier lug cavity 40 having a first wall 41 and a second opposite wall 43.

The actuator cavity 24 comprises a cylinder bore 42 open at one end to the exterior of the housing 12. A fluid passage 44 extends radially outwardly from the cylinder bore 42, in fluid communication therewith, to the housing exterior. The cylinder bore 42 extends terminates in a shoulder 46 which leads to a push rod shaft bore 48, which at an end opposite to the cylinder bore 42 is in communication with the carrier lug cavity 40 opening through the second wall 43. On the opposite side of the carrier lug cavity 40, extending from the first wall 41, there is provided a return spring cavity 50, which is also cylindrical and is aligned with the push rod shaft bore 48.

The driving gear assembly 14 comprises a drive shaft 52 extending from outside the housing 12 so as to be driven by a drive shaft from, e.g. an internal combustion engine. Mounted on the driving shaft 52 there is provided a driving gear 54 having a circular body 56 with a plurality of gear teeth 58 extending radially therefrom, each to a tip 60. Between each of the gear teeth 58 there is provided a root 62.

The driven gear assembly 16 comprises a carrier 64, an idler shaft 66 and a driven gear 68.

The carrier 64 is a crescent-shaped body being generally semi-circular extending from a first end 70 to a second end 72 through a 180 degree arc. On a radially inwardly facing side of the carrier 64, there is provided a gear pump contact surface 78, which is semi-circular and has a radius similar to that of the gear pump contact surface 34. On the radially outwardly facing side of the carrier 64, there is provided a housing facing surface 80. At the first end 70, the carrier 64 comprises a carrier rotation pin receiving formation 74. Proximate the second end 72, the carrier 64 defines a housing bearing surface 65 describing a convex circle segment and projecting from the housing facing surface 80. A seal recess 84 containing a radially outwardly facing seal 86 is provided in the bearing surface 65. A radially outwardly extending lug 76 is provided at the second end 72 of the carrier 64. The lug 76 defines a semicircular ball socket 82.

Extending radially inwardly from the carrier 64, there is provided an idler shaft support structure (not visible), which supports the idler shaft 66. The idler shaft is mounted for rotation concentric with the gear pump contact surface 78. As shown in FIGS. 1*a* and 1*b*, the driven gear 68 is supported on the idler shaft 66. The driven gear 68 comprises a body 88 having a number of radially outwardly extending gear teeth 90, each having a tip 92 and roots 94 defined therebetween.

The actuator 18 comprises a piston 96 and a push rod 98 extending axially therefrom. A seal cap 100 is also provided.

The actuator 18 further comprises a return spring 102 and a ball bearing 104.

The pump 10 is assembled as follows.

The driving gear assembly 14 is mounted in the housing 12 such that the driving gear 54 is driven to rotate within the first gear cavity 30. As such, the driving shaft 52 is mounted for concentric rotation with the gear pump contact surface 34 such that the tips 60 of the teeth 58 move along the contact surface 34 with minimal or no gap when the gear 54 rotates. The gear 54 is configured for rotation in an anti-clockwise sense such that the gear teeth 58 rotate from the inlet 26, opposite to the driven gear 88 around the contact surface 34 towards the outlet 28.

The driven gear assembly 16 is mounted within the second gear cavity 32. The carrier 64 is mounted to a carrier rotation pin 106 which is simultaneously engaged with the carrier rotation pin receiving formation 38 on the housing and the carrier pin receiving formation 74 on the carrier 64. The carrier 64 is thereby mounted for rotation about a carrier pin axis C.

Movement of the carrier about the axis C causes the seal 86 to brush along the concave sealing region 39. Comparing FIGS. 1*a* and 1*b*, the carrier is shown in a first position in FIG. 1*a* and a second, different position in FIG. 1*b*, having rotated in an anti-clockwise sense about the axis C.

The driven gear 68 is mounted on the idler shaft 56 such that the tips 92 of the teeth 90 move along the contact surface 78 with minimal or no gap when the gear 68 rotates. Because the driven gear 68 is mounted on the carrier 64, rotation of the carrier 64 about the axis C moves the driven gear 68 between the position shown in FIG. 1*a* to the position shown in FIG. 1*b*. As can be seen in FIG. 1*a*, the tips 92 of the gear teeth 90 of driven gear 88 are proximate the roots 62 of the driving gear 56. By comparison, in FIG. 1*b* the gears have become less engaged. In other words, the distance between the axes of rotation of the driving gear and driven gear has increased by virtue of movement of the carrier 64.

The carrier 64 is moved by applying opposing forces on the lug 76. This is achieved with the actuation assembly 18.

The piston 96 is positioned within the cylinder 42, and the seal cap 100 used to seal the cylinder 42 to form a hydraulic chamber. Hydraulic pressure from the passage 44 supplied the cylinder 42 moves the piston 96 to the left in FIGS. 1*a* and 1*b*. Movement of the piston 96 moves the push rod 98 which pushes on the lug 76 of the carrier 64 to rotate it in an anti-clockwise sense about the carrier rotation axis C.

The return spring 102 is arranged to bear upon a ball bearing 104 recess 82 of the carrier 64. As such, when hydraulic pressure is released from the passage 44, the piston 96 moves right, towards the seal cap 100, thus decreasing force on the lug 76. As such under the force of the return spring 102, the carrier returns to its position shown in FIG. 1*a*.

During operation of the gear pump in the configuration shown in FIG. 1*a*, rotation of the driving gear 54 in an anti-clockwise sense results in simultaneous rotation of the driven gear 68 in a clockwise sense by virtue of the meshing of the teeth. Because each of the gears bears against the respective contact surface during its passage, discrete volumes of fluid will be trapped between the gears and transported around the edge of the gear pump from the inlet 26 to the outlet 28. Once past their respective contact surfaces, the teeth continue to rotate back towards the inlet 26. It will be noted that although some high pressure fluid will be entrained between the gear teeth and the opposing gear root on the return journey between the outlet and the inlet, these volumes are much smaller than the larger volumes between the various gear teeth and the contact surfaces and, as such, there is a net pumping effect from the inlet 26 to the outlet 28.

Turning to FIG. 1*b*, when the carrier 64 is rotated in an anti-clockwise sense about axis C, the axis of the driven gear is moved away from the axis of the driving gear thus increasing the space between the tips 92 of the teeth 90 of the driven gear, and the roots 62 of the driving gear. As a result the gaps formed between the meshing gears allow more fluid to move from the outlet 28 to the inlet 26, and the net pumping effect of the gear pump is reduced. In this manner, a variable flow can be achieved by controlling the position of the carrier 64 which controls the distance between the axes of the two gears.

Figure 2A:
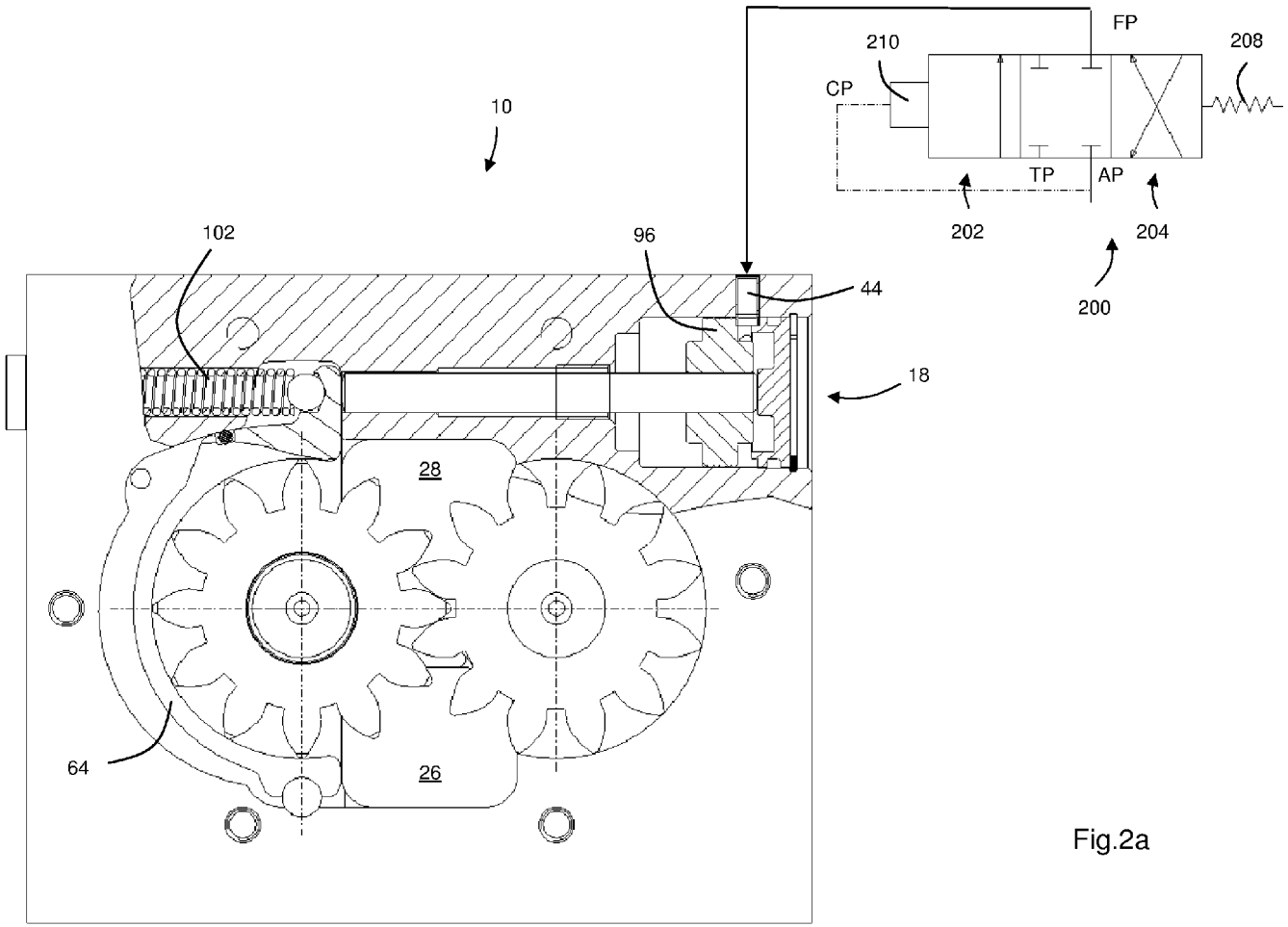

Turning to FIG. 2*a*, there is shown the gear pump 10 of FIGS. 1*a* and 1*b* in an assembly with a control valve 200. The control valve 200 is shown in diagrammatic form. The control valve 200 is a spool valve having two positions 202, 204. (The valve is shown in an intermediate position where all the valve ports are blocked).

The spool valve 200 has a return spring 208 and a pressure face 210. The spring 208 and fluid pressure on the pressure face 210 are arranged to move the spool valve 200 in opposite directions between the two positions 202, 204 in a known manner.

The control valve 200 has:

- a control port CP in communication with the pressure face 210 at one axial end of the spool;
- an actuation port AP in communication with a first side of the spool valve 200;
- a tank port TP in fluid communication with the first side of the spool valve 200; and,
- a feed port FP in fluid communication with the passage 44 of the actuator 18 of the pump 10.

In the embodiment of FIG. 2*a*, the control port CP and the actuation port AP are in fluid communication. Both are in communication with an area of fluid pressure downstream of the outlet 28 of the pump 10.

When the pressure at the control port CP is low, the spring 208 urges the spool valve 200 into the position 204. The feed port FP is in communication with the tank port TP and as such the low pressure at the passage 44 allows the spring 102 to urge the piston 96 to the rightmost position. In this condition the pump is at maximum flow and serves to increase the pressure at the outlet 28 (and hence at the control port CP).

When the pressure at the control port CP increases, the spool valve 200 moves to the right to compress the spring 208. This causes the valve 200 to be moved to the position 202 in which the actuation port AP is connected to the feed port FP. This feeds high pressure fluid to the passage 44 of the pump 10 to move the piston 96 to the left. This compresses the spring 102 and moves the carrier 64 in an anti-clockwise sense about axis C (i.e. from FIG. 1*a* to 1*b*). This has the effect of separating the gears to control the pump pressure at the outlet 28.

A drop in the pressure at the control port CP will result in the spool valve moving back to position 204 where the cylinder in which the piston 96 sits is connected to the tank port TP via the feed port FP and the pump output is increased.

In this manner, the gear pump 10 is controlled by the control pressure P.

Figure 2B:
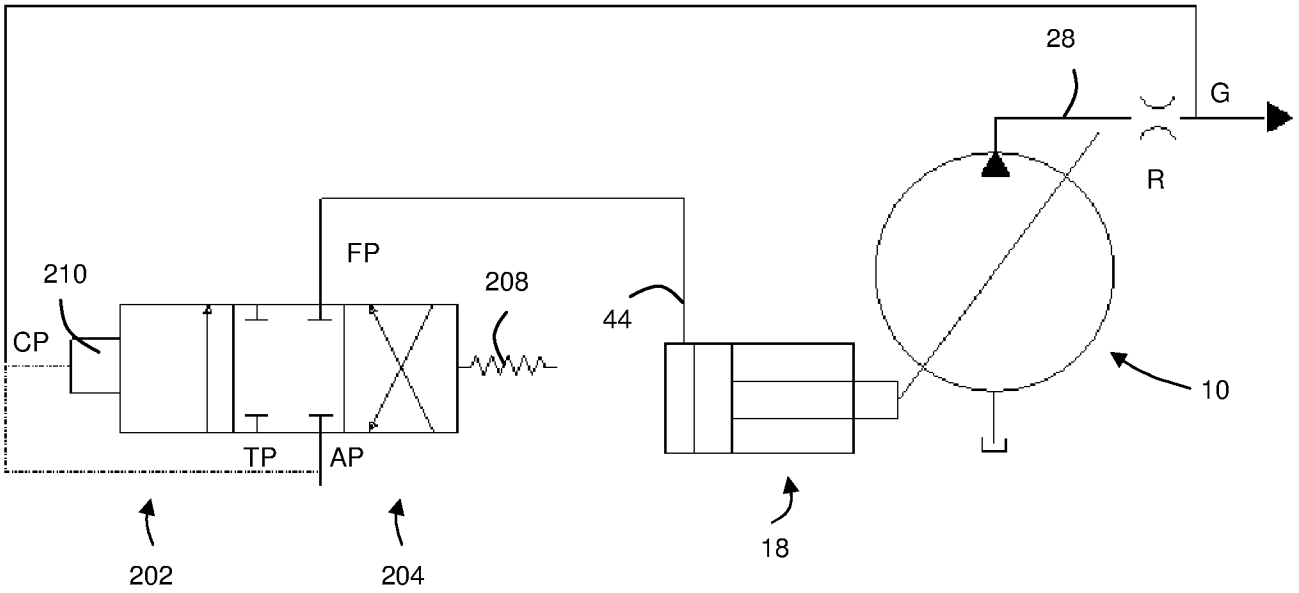

This arrangement is shown as a hydraulic circuit diagram in FIG. 2*b*, whereby the control port P and actuation ports are in fluid communication with an oil gallery G, downstream of a flow restriction R. For example, the oil gallery G may be a passage leading to a vehicle bearing. In this instance, the restriction is the entrance to the passage.

The configuration shown in FIG. 2*b* uses the gallery pressure to both control the pump 10, and to actuate it's control mechanism (in the form of the piston 96).

Figure 3:
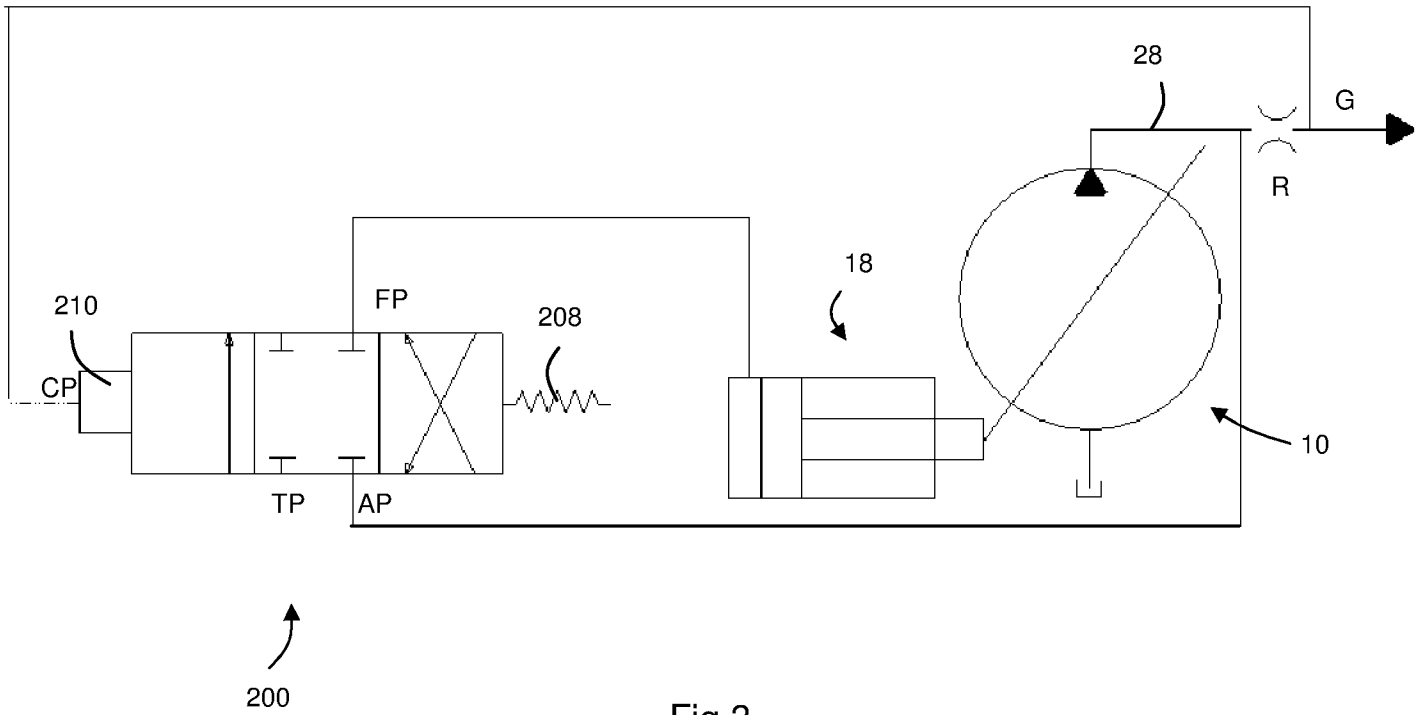
FIG. 3 is a schematic view of the pump of FIG. 1*a* with a second control scheme.

Turning to FIG. 3, an alternative hydraulic circuit is provided wherein common components are numbered identically to those shown in FIGS. 2*a* and 2*b*. In FIG. 3, the control port CP is still connected to the gallery G (i.e. downstream of the restriction R). However the actuation port AP is connected immediately downstream of the outlet 28—i.e. upstream of the restriction R.

The pressure at the outlet 28 is higher than the gallery pressure G (due to the restriction R), and results in the carrier 64 being moved faster than if the gallery pressure G was used to actuate the cylinder 42.

Turning to FIG. 4, an alternative embodiment 10' of the gear pump 10 is shown. The gear pump 10' is very similar to the gear pump 10 with the exception of the differences which will be discussed below. The gear pump 10' comprises a housing 12', a driving gear assembly 14', and a driven gear assembly 16'. The gear assemblies 12', 14' are disposed on a gear cavity 22'. An inlet 26' leads to an outlet 28' on the opposite side of the gear pump arrangement.

A carrier 64' is provided, being similar to the carrier 64 extending from a first end 70' to a second end 72' and being mounted on a carrier rotation pin 106' for rotation about an axis C'. The carrier 64' defines a convex bearing surface 65' having a seal 86' which brushes against a concave bearing surface 39' in the housing 12'. The convex bearing surface 65' and the concave bearing surface 39' have the same radius, both with geometrical centres coincident with carrier rotation axis C'.

As such, a variable carrier pressure chamber 302' is formed between a housing facing surface 80' of the carrier 64' and a carrier facing surface 36' of the housing 12'. The chamber 302' is sealed by the pin 106' at the first end 70' of the carrier and the seal 86' at the second end 72' of the carrier 64'.

Although the carrier 64' comprises a radially extended lug 76', this lug is not actuated upon. It is only used so as to limit the travel of the carrier 64' within the carrier lug cavity 40' of the housing 12' by abutment with opposed carrier lug abutment surfaces 41', 43'.

A difference between the pump 10' is the provision of a fluid passage 300' proximate the carrier contact surface 36' in communication with the carrier pressure chamber 302'. Actuation of the carrier 64' is provided by controlling the pressure through the passage 300', i.e., to the chamber 302'. An increase in pressure in the chamber 302' will force apply a net pressure to the housing facing surface 80' of the carrier 64' causing it to rotate in a clockwise sense about the axis C'. A reduction in pressure in the chamber 302' will result in the net pressure on the carrier 64' to rotate it in an anti-clockwise sense about the axis C'. As such increasing pressure in the chamber 302' will increase the pressure at the outlet 28, and vice versa.

An example of the operation of the pump 10' can be seen in FIG. 5*a* where a spool valve 400 is shown having two positions 402, 404, a return spring 408 and a pressure face 410. As with the valve 200, the valve 400 is provided with a control port CP which is in fluid communication with the pressure face 410, an actuation port AP, a feed port FP connected to the passage 300' of the pump 10', and a drain tank port TP.

The pressure at the control port CP is always taken downstream of the outlet 28 to ensure closed loop control. In this embodiment, the control port CP and the actuation port FP are taken from the same point.

When the pressure at the control port CP is low, the spring 208 urges the spool valve 400 into the second position 404. The feed port FP is in communication with the actuation port AP and as such the high pressure at the passage 300' urges the carrier 64' in a clockwise direction to move the gears closer together. In this condition the pump is at maximum flow and serves to increase the pressure at the outlet 28 (and hence at the control port CP).

As the pressure at the control port CP rises, the pressure on the pressure face 410 of the spool valve 400 increases and the valve moves to the first position 402. This connects the passage 300' to drain port TP which releases pressure in the chamber 302'. The pressure differential across the carrier 64' causes it to rotate in an anti-clockwise sense and thus increase separation between the two meshing gears and thereby lower the pressure at the outlet 28'. As a result, the pressure at the control port CP is controlled.

If the pressure at the control port CP drops too far, the spool valve 400 eventually moves back under the action of return spring 408 to the second position 404.

This system is shown as a hydraulic circuit diagram in FIG. 5*b*, where it can be seen there is a restriction R between the outlet 28' and an oil pressure gallery G, which is used as the control and actuation pressure.

Turning to FIG. 6, there is shown an alternative embodiment of the control system relating to the pump 10' in which the gallery pressure is used for control at the pressure face 410 of the valve 400. Instead of the gallery pressure G being used as an inlet pressure at the actuation port AP to control the position of the carrier 64', the outlet pressure 28' is used.

Variations fall within the scope of the present invention.

As discussed above, the above described embodiments, and individual features thereof, may be used in hydraulic motors instead of pumps. In this instance, a high pressure inlet forces the rotors to rotate to drive a mechanical output shaft as the fluid flows to a low pressure outlet. With respect to the control schemes. In this instance, electronic control of the distance between the rotors may be used to control the mechanical output power.

Although the working fluid is usually a liquid (i.e. hydraulic), it may be a gas (i.e. pneumatic).

The subject machine may be reversible. For hydraulic pumps it may be desirable to reverse the rotation of the driving rotor to pump fluid in the opposite direction. This falls within the scope of the invention.

Different actuation methods may be used to control the position of the carrier. A linear electric actuator may be used to move the carrier in place of the hydraulic actuator 18. A rotational actuator such as an electric motor may directly drive the rotation of the carrier 64.

The carrier does not need to be rotatable, for example it may be slidable away from and towards the driving gear, however, it is understood that a rotating system is fundamentally more reliable and simple.

The number of gear teeth and the nature of the rotors may be varied depending on the application. For example, instead of having a driving and driven rotor, the two rotors may be lobed (as in a lobe pump) and may contain some kind of external synchronisation system for ensuring that they rotate in the appropriate manner to supply a fluid from the inlet to the outlet.

Both rotors may be driven, or the carrier rotor may be driven instead of the static rotor (although this is more complex to achieve).

Both rotors may move to vary the distance between their axes.

A three rotor pump may be provided with a central driven rotor and two idlers either side. In this case one or both idler rotors may be movable relative to the central rotor to vary the flow.

The invention claimed is:

1. A variable flow external rotor hydraulic machine comprising:

a housing comprising a pump cavity, the pump cavity defining an inlet and an outlet;

a rotor set having a first rotor mounted for rotation about a first rotor axis and a second rotor mounted for rotation about a second rotor axis, the rotor set being configured to either:

(i) when driven, pump fluid from the inlet to the outlet; or, (ii) be driven by a working fluid passing from the inlet to the outlet;

wherein at least one of the first and second rotor axes is movable relative to the other to vary a leakage flow between the rotors; and a carrier rotatably movable relative to the housing;

wherein the second rotor is mounted on the carrier;

wherein the carrier comprises a surface facing the second rotor; and wherein the carrier forms a carrier pressure chamber with the housing on the opposite side of the carrier to the second rotor, wherein the position of the carrier is responsive to a pressure in the carrier pressure chamber and to a pressure within the pump cavity.

2. A variable flow external rotor hydraulic machine according to claim 1, wherein the first rotor axis is stationary, and the second rotor axis is movable.

3. A variable flow external rotor hydraulic machine according to claim 2, wherein the first rotor is connected to a shaft configured to either be:

(i) an input shaft driven by an external power source; or, (ii) an output shaft, and wherein the second rotor is an idler.

4. A variable flow external rotor hydraulic machine according to claim 1, wherein the second rotor and the surface cooperate to form moving fluid chambers.

5. A variable flow external rotor hydraulic machine according to claim 1, wherein the carrier comprises a carrier axis of rotation and a sealing region for sealing against a corresponding surface of the housing.

6. A variable flow external rotor hydraulic machine according to claim 5, wherein at least one of the sealing region of the carrier and the corresponding surface of the housing comprises a circle segment surface with a geometric centre at the carrier axis of rotation.

7. A variable flow external rotor hydraulic machine according to claim 5, wherein at least one of the sealing region of the carrier and the corresponding surface of the housing comprises a seal.

8. A variable flow external rotor hydraulic machine according to claim 5, wherein the sealing region of the carrier is spaced apart from the carrier axis.

9. A variable flow external rotor hydraulic machine according to claim 1, wherein the pressure chamber comprises a flow passage for controlling the pressure therein.

10. A variable flow external rotor hydraulic machine according to claim 9, wherein the pressure in the pressure chamber is controlled by a control valve driven by a pressure downstream of the outlet.

11. A variable flow external rotor hydraulic machine according to claim 10, wherein the control valve is actuated by the pressure downstream of the outlet.

12. A variable flow external rotor hydraulic machine according to claim 10, wherein the control valve is configured to supply the pressure chamber using a flow downstream of the outlet.

13. A method of controlling the flow in an external rotor hydraulic machine comprising the steps of:

providing a housing comprising a pump cavity, the pump cavity defining an inlet and an outlet;

providing an external rotor hydraulic machine having a rotor set positioned between the inlet and the outlet, the rotor set having a first rotor mounted for rotation about a first rotor axis and a second rotor mounted for rotation about a second rotor axis;

providing a carrier rotatably movable relative to the housing, the carrier comprising a surface facing the second rotor, mounting the second rotor on the carrier, wherein the carrier forms a carrier pressure chamber with the housing on the opposite side of the carrier to the second rotor;

either:

(i) rotating the first and second rotors about their respective axes to pump fluid from the inlet to the outlet; or, (ii) providing a high pressure fluid at the inlet to rotate the first and second rotors about their respective axes as the fluid passes to the outlet to generate a mechanical output; and, varying the output of the hydraulic machine by moving one or both of the first and second rotor axes relative to the other by changing the position of the carrier in response to a pressure in the carrier pressure chamber and to a pressure within the pump cavity.

* * * * *